US006332459B1

(12) United States Patent
Ehara et al.

(10) Patent No.: US 6,332,459 B1
(45) Date of Patent: Dec. 25, 2001

(54) CONTROL SYSTEM OF AIR-FUEL RATIO SENSOR HEATER TEMPERATURE FOR INTERNAL COMBUSTION ENGINE

(75) Inventors: Yasunori Ehara; Shuji Nagatani, both of Wako (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/552,148

(22) Filed: Apr. 19, 2000

(30) Foreign Application Priority Data

Apr. 20, 1999 (JP) ..... 11-111933

(51) Int. Cl.[7] ..... F02D 41/00
(52) U.S. Cl. ..... 123/697; 73/23.32
(58) Field of Search ..... 123/697; 73/23.32

(56) References Cited

U.S. PATENT DOCUMENTS 5,544,640 * 8/1996 Thomas et al. ..... 123/687
5,669,219 * 9/1997 Schnailbel et al. ..... 123/697
6,055,972 * 5/2000 Fujimoto et al. ..... 123/697

FOREIGN PATENT DOCUMENTS 4-37264 6/1992 (JP) .
7-91292 4/1995 (JP) .
8-7176 1/1996 (JP) .

* cited by examiner

*Primary Examiner*—John Kwon
(74) *Attorney, Agent, or Firm*—Arent Fox Kintner Plotkin & Kahn, PLLC

(57) ABSTRACT

A system for controlling a temperature of an air-fuel ratio sensor heater of an direct injection spark ignition engine which is operated at an ultra-lean burn combustion or at a pre-mixture charged combustion. In the system, the temperature of the air-fuel ratio sensor is estimated and the supply of current to the heater is determined in terms of a duty ratio in PWM based on the estimated temperature of the air-fuel ratio sensor and is increased when the engine is determined to be operated at the ultra-lean burn combustion. The duty ratio is increased by an augmentative on-time which is determined based on a parameter such as a desired torque, an engine speed and load, or a vehicle speed. The supply of current is also increased when the operation of the EGR is in progress.

28 Claims, 9 Drawing Sheets

CONTROL SYSTEM OF AIR-FUEL RATIO SENSOR HEATER TEMPERATURE FOR INTERNAL COMBUSTION ENGINE

BACKGROUND OF THE INVENTION

1. Field of the Invention

This invention relates to a control system of air-fuel ratio sensor heater temperature for an internal combustion engine, more particularly to a control system of heater temperature of an air-fuel ratio sensor, to be installed at the exhaust system of a direct injection spark ignition engine, which detects the air/fuel ratio of the exhaust gas generated by the engine.

2. Description of the Related Art

When installing an air-fuel ratio sensor at the engine exhaust system to detect the air/fuel ratio of the exhaust gas, since the sensor output varies with the temperature at its sensing element, it has been proposed providing a heater at the sensor and controlling the heater temperature based on the detected engine load or a similar parameter, as is taught by, for example, Japanese Patent Publication No. Hei 8 (1996)-7176.

In this prior art, a well-known oxygen sensor ($O_2$ sensor) is used, as the air-fuel ratio sensor, whose output changes each time the exhaust air/fuel turns from lean to rich and vice versa with respect to a stoichiometric air/fuel ratio. Another air-fuel ratio sensor called "universal" sensor or "wide range" sensor has recently been proposed which generates outputs indicative of the exhaust air/fuel ratio that changes linearly in proportion to the oxygen concentration in the exhaust gas. Thus, the universal sensor can detect the extent of how lean or rich the exhaust air/fuel ratio is with respect to the stoichiometric air/fuel ratio. The assignee proposes this kind of sensor in Japanese Laid-Open Patent Application No. Hei 7 (1995)-91292.

Aside from the above, a direct injection spark ignition engine has recently been proposed in which gasoline fuel is directly injected into the combustion chamber such that an ultra-lean burn combustion or a stratified combustion (in an ultra lean air/fuel ratio) or the pre-mixture charged combustion (in a uniform air/fuel ratio) occurs in the engine as is disclosed in, for example, Japanese Patent Publication No. Hei 4 (1992)-37264.

In the direct injection spark ignition engine, since the form of combustion is different form each other, the engine operation is switched, in response to the engine load, between the operation in which the ultra-lean burn combustion occurs and that in which the pre-mixture charged combustion occurs.

When switched from the pre-mixture charged combustion operation to the ultra-lean burn combustion operation, since the form of combustion differs, the combustion temperature drops even if the intake air amount remains unchanged. This increases heat transfer from the sensing element to the ambient exhaust gas. As a result, the temperature at the sensing element drops which results in the element resistance change. At worse, this temperature drop could degrade the sensing function due to the change occurring in the molecular structure named "blacking".

SUMMARY OF THE INVENTION

An object of the present invention is therefore to provide a control system of air-fuel ratio sensor heater temperature for an internal combustion engine which can control the temperature of a heater of an air-fuel ratio sensor installed at a direct injection spark ignition engine within a predetermined range, thereby enabling to overcome the drawbacks mentioned in the above.

This invention achieves this object by providing a system for controlling a temperature of a heater of an air-fuel ratio sensor installed in an internal combustion engine and generating a signal indicative of an air/fuel ratio in an exhaust gas generated by the engine; including; the heater installed at the air/fuel ratio sensor and for heating a sensing element of the air/fuel ratio sensor when supplied with current; and current supply control means for controlling a supply of current to the heater; wherein the improvement comprises; the engine is a direct injection spark ignition engine which is operated at an ultra-lean burn combustion or at a pre-mixture charged combustion; and the system includes:sensor temperature determining means for determining the temperature of the air-fuel ratio sensor; and combustion determining means for determining whether the engine is operated at the ultra-lean burn combustion; and the current supply control means controls the supply of current to the heater based at least on the determined temperature of the air-fuel ratio sensor and a result of determination whether the engine is operated at the ultra-lean burn combustion.

BRIEF EXPLANATION OF THE DRAWINGS

This and other objects and advantages of the invention will be more apparent from the following description and drawings, in which.

DETAILED DESCRIPTION OF THE PREFERRED EMBODIMENTS

Embodiments of the present invention will now be explained with reference to the drawings.

Figure 1:
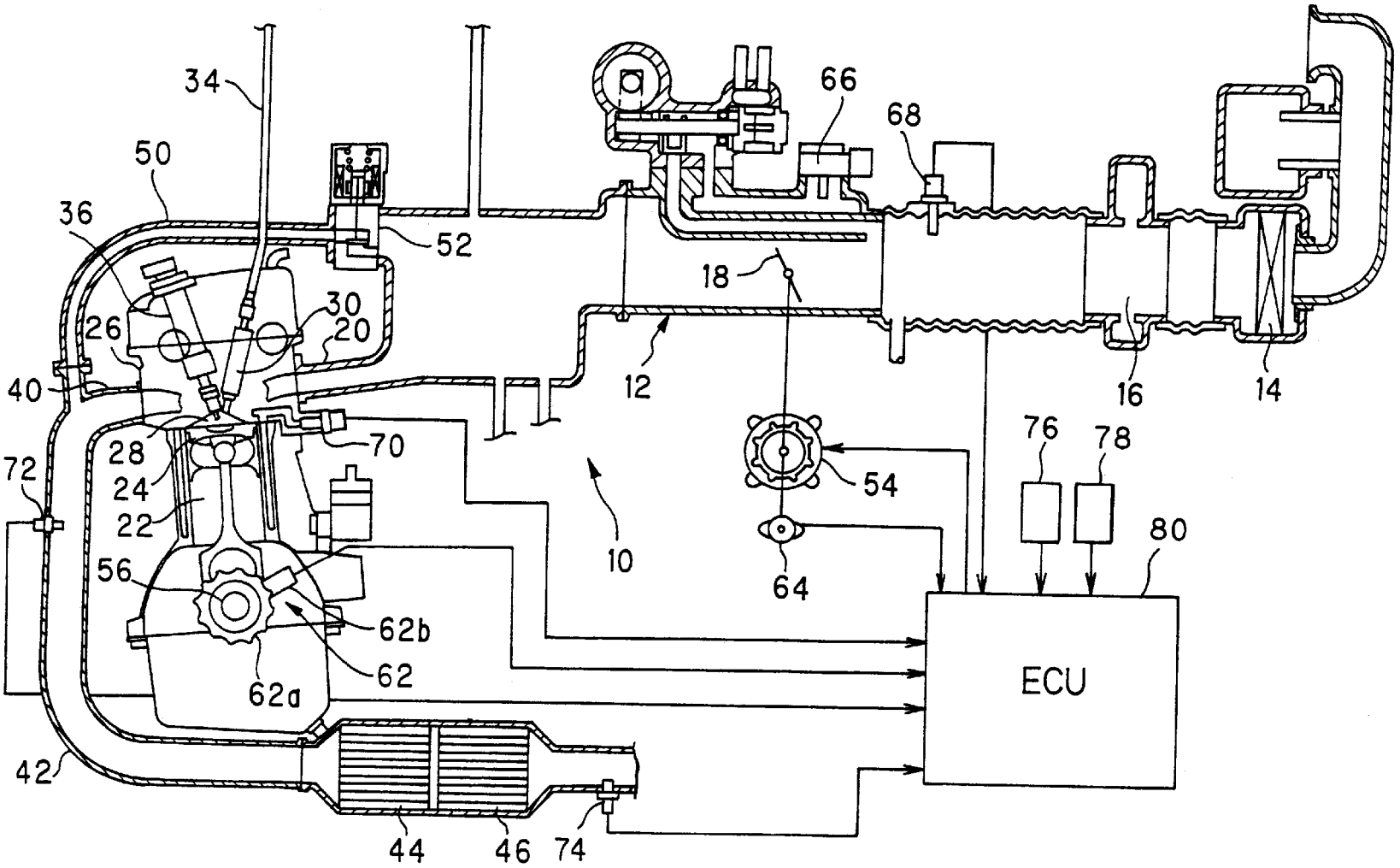
FIG. 1 is an overall schematic view showing a control system of air-fuel ratio sensor heater temperature for an internal combustion engine according to an embodiment of the invention.

FIG. 1 is an overall schematic view of a control system of air-fuel ratio sensor heater temperature for an internal combustion engine according to an embodiment of the invention.

Reference numeral 10 in this figure designates an OHC in-line four-cylinder internal combustion engine. Air drawn into an air intake pipe 12 through an air cleaner 14 mounted on its far end flows through a surge tank 16 and an intake manifold 20, while the flow thereof is adjusted by a throttle valve 18, to two intake valves (not shown) of respective one of the first to fourth cylinders 22 (for brevity of illustration, only one is shown in the figure).

Each cylinder 22 has a piston 24 which is displaceable in the cylinder 22. The top of the piston 24 is recessed such that a combustion chamber 28 is formed in a space defined by the recessed cylinder top and the inner wall of a cylinder head (and the inner wall of the cylinder 22). A fuel injector 30 is provided in the vicinity of the center of the ceiling of the combustion chamber 28. The fuel injector 30 is connected to a fuel supply pipe 34 and is supplied with pressurized fuel (gasoline) from a fuel tank (not shown) pumped by a pump (not shown) and injects fuel directly into the combustion chamber 28 when opened. The injected fuel mixes with the air and forms the air-fuel mixture.

A spark plug 36 is provided in the vicinity of the fuel injector 30 which is supplied with electric energy from an ignition system including an ignition coil (neither shown) and ignites the air-fuel mixture at a predetermined ignition timing in the order of the first, the third, the fourth and the second cylinder. The resulting combustion of the air-fuel mixture drives down the piston 24.

Thus, the engine 10 is a direct injection spark ignition engine in which the gasoline fuel is directly injected into the combustion chamber 28 of respective cylinders 22 through the fuel injector 30.

The exhaust gas produced by the combustion is discharged through two exhaust valves (not shown) into an exhaust manifold 40, from where it passes through an exhaust pipe 42 to a catalytic converter 44 (for removing NOx in the exhaust gas) and a second catalytic converter 46 (three-way catalyst for removing NOx, CO and HC in the exhaust gas) to be purified and then flows out of the engine 10.

The exhaust pipe 42 is connected, at a location downstream of the confluence point of the exhaust manifold 40, to the air intake pipe 12 by an EGR conduit 50 so as to recirculate the exhaust gas partially in the operation of EGR (Exhaust Gas Recirculation). An EGR control valve 52 is provided at the EGR conduit 50 to regulate the amount of EGR.

The throttle valve 18 is not mechanically linked with an accelerator pedal (not shown) installed at the floor of a vehicle operator seat (not shown), but is connected to a stepper motor 54 to be driven by the motor to open/close the air intake pipe 12. The throttle valve 18 is operated in such a DBW (Drive-By-Wire) fashion.

The piston 24 is connected to a crankshaft 56 to rotate the same. A crank angle sensor 62 is installed in the vicinity of the crankshaft 56, which comprises a pulser 62*a* fixed to the rotating crankshaft 56 and an electromagnetic pickup 62*b* fixed to an opposing stationery position. The crank angle sensor 62 generates a cylinder discrimination signal (named "CYL") once every 720 crank angular degrees, a signal (named "TDC" (Top Dead Center)) at a predetermined BTDC crank angular position and a unit signal (named "CRK") at 30 crank angular degrees obtained by dividing the TDC signal interval by six.

A throttle position sensor 64 is connected to the stepper motor 54 and generates a signal indicative of the opening degree of the throttle valve 18 (named "TH"). A manifold absolute pressure (MAP) sensor 66 is provided in the air intake pipe 12 downstream of the throttle valve 18 and generates a signal indicative of the engine load, more precisely the absolute manifold pressure (named "PBA") generated by the intake air flow there through a conduit (not shown).

An intake air temperature sensor 68 is provided at a location upstream of the throttle valve 18 (close to the air cleaner 14) and generates a signal indicative of the temperature of intake air (named "TA"). And a coolant temperature sensor 70 is installed in the vicinity of the cylinder 22 and generates a signal indicative of the temperature of an engine coolant (named "TW").

Further, a universal (or wide range) sensor (air-fuel ratio sensor) 72 is installed at the exhaust pipe 42 at a position upstream of the catalytic converters 44, 46 and generates a signal indicative of the exhaust air/fuel ratio that changes linearly in proportion to the oxygen concentration in the exhaust gas. This sensor 72 is hereinafter referred to as "LAF" sensor. In addition, an $O_2$ sensor (air-fuel ratio sensor) 74 is provided at a position downstream of the catalytic converters 44, 46 and generates a signal which changes each time the exhaust air/fuel turns from lean to rich and vice versa with respect to a stoichiometric air/fuel ratio.

Furthermore, an accelerator position sensor 76 is provided in the vicinity of the accelerator pedal which generates a signal indicative of the position (opening degree) of the accelerator pedal (named "θAP"). And a vehicle speed sensor 78 is installed in the vicinity of a drive shaft (not shown ) of the vehicle (not shown) on which the engine 10 is mounted and generates a signal indicative of the vehicle running condition (vehicle speed named "V").

The outputs of the sensors are sent to an ECU (Electronic Control Unit) 80. The ECU 80 comprises a microcomputer having a CPU, a ROM, a RAM (all not shown), etc. The CRK signal generated by the crank angle sensor 62 is counted by a counter (not shown) in the ECU 80 and the engine speed NE is detected or calculated.

In the ECU 80, the CPU determines or calculates the fuel injection amount and ignition timing based on the detected parameters obtained by the sensors and including the detected engine speed NE. Explaining the determination of the fuel injection amount more specifically, the CPU determines a desired torque (named "PME") to be generated by the engine 10 based on the detected engine speed NE and the detected accelerator position θAP. The CPU then determines or calculates a desired air/fuel ratio KCMD to be supplied to the engine 10 based on the determined desired torque PME and the detected engine speed NE.

Parallel with the above, the CPU determines or calculates a basic injection amount (named "TI") based on the detected engine speed NE and the manifold absolute pressure PBA. Based on the determined basic injection amount, it then determines an output injection amount (named "TOUT") as follows. The amounts TI and TOUT are determined in terms of the fuel injector opening period.

$$TOUT=TI\times KCMDM\times KEGR\times KLAF\times KT+TT$$

In the above, KCMDM is a desired air/fuel ratio correction coefficient and is determined by correcting the desired air/fuel ratio KCMD by the charging efficiency. The values KCMD and KCMDM are, in fact, determined in terms of the equivalence ratio.

In the above, KEGR is a correction coefficient for correcting the disturbance caused by EGR and is determined based on the desired torque PME and the engine speed NE.

KLAF is a feedback correction coefficient and is determined based on the output of the LAF sensor 72. KT is the product of other correction factors in multiplication form and TT is the sum of other correction factors in additive and subtractive form.

As regards the desired air/fuel ratio KCMD, the CPU determines it such that the actual air/fuel ratio in the vicinity of the spark plug 36 falls within a range from 12.0:1 to 15.0:1, irrespective of the engine load, while the actual average air/fuel ratio (averaged air/fuel ratio throughout the cylinder 22) falls within a range from 12.0:1 to 15.0:1 at a high engine load, within a range exceeding thereof but up to 22.0:1 at a medium engine load, and within a range exceeding thereof but up to 60.0:1 at a low engine load. Moreover, the CPU controls to inject fuel during the intake stroke at a high or medium engine load, while controlling to inject fuel during the compression stroke at a low engine load. The injected fuel mixes with the intake air and is ignited, resulting in the ultra-lean burn combustion (DISC (Direct Injection Stratified Charged) combustion) or the pre-mixture charged combustion.

Explaining the determination of the ignition timing, the CPU determines a basic ignition time based on the detected engine speed NE and the engine load (manifold absolute pressure PBA) and by correcting the same by the detected coolant temperature TW and some similar parameters, determines an output ignition timing to be supplied to the engine 10.

Figure 2:
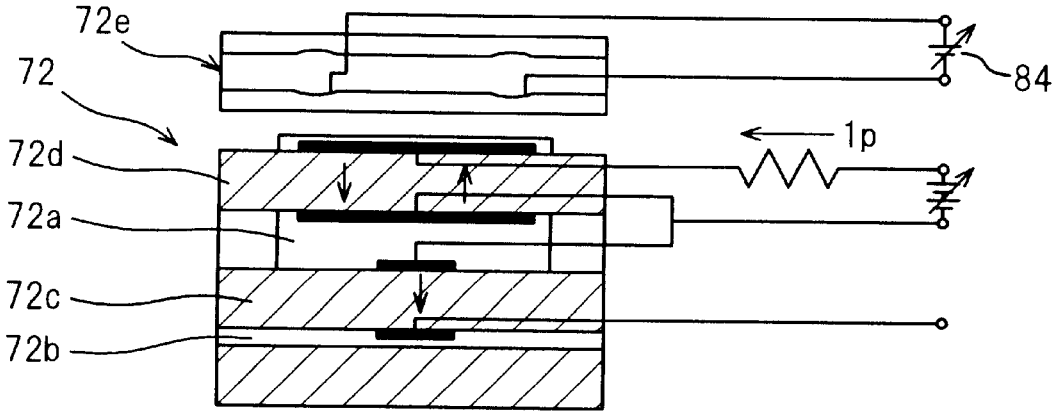
FIG. 2 is a cross sectional view showing a sensing element of the air-fuel ratio sensor illustrated in FIG. 1.

FIG. 2 is a cross sectional view showing the structure of the sensing element of the LAF sensor 72.

As is disclosed in the aforesaid Japanese Laid-Open Patent Application (No. Hei 7 (1995)-91292, the LAF sensor 72 has a diffusion barrier 72*a*, air reference 72*b*, an oxygen concentration cell 72*c* (sandwiched in between) with a solid-electrolyte through which the current is carried by oxygen ions, and a pump cell 72*d* formed opposite to the oxygen concentration cell 72*c* sandwiching the diffusion barrier 72*a* converges to a predetermined value. The voltage of the oxygen concentration cell 72*c* is compared with a reference voltage and a pump current Ip is supplied to the electrodes of the pump cell 72*d* in response to the result of comparison such that the oxygen concentration in the diffusion barrier 72*a* is maintained at a predetermined value. The pump current value is detected and is amplified through an amplifier (not shown), which indicates the oxygen concentration, i.e., the air/fuel ratio in the exhaust gas.

A heater 72*e* is installed in the vicinity of the pump cell 72*d*, which is supplied with a current through heater current supply circuit 84 to heat the sensing element including the pump cell 72*d*.

This kind of sensor is not active until the temperature of the sensing element including the pump cell 72*d* has reached 700° C. or thereabout and as a result, the sensor output characteristic (pump current characteristic) is not stable. Further, even after the temperature rises to that activation level, the sensor output characteristic still depends on the temperature to a certain extent. Moreover, if the temperature drops below the activation level, the sensor degradation problem due to the blacking could occur.

In the system according to the embodiment it is therefore configured to supply a current to the heater 72*e* through the heater current supply circuit 84 to control the temperature including the pump cell 72*d* of the sensing element of the LAF sensor 72.

Figure 3:
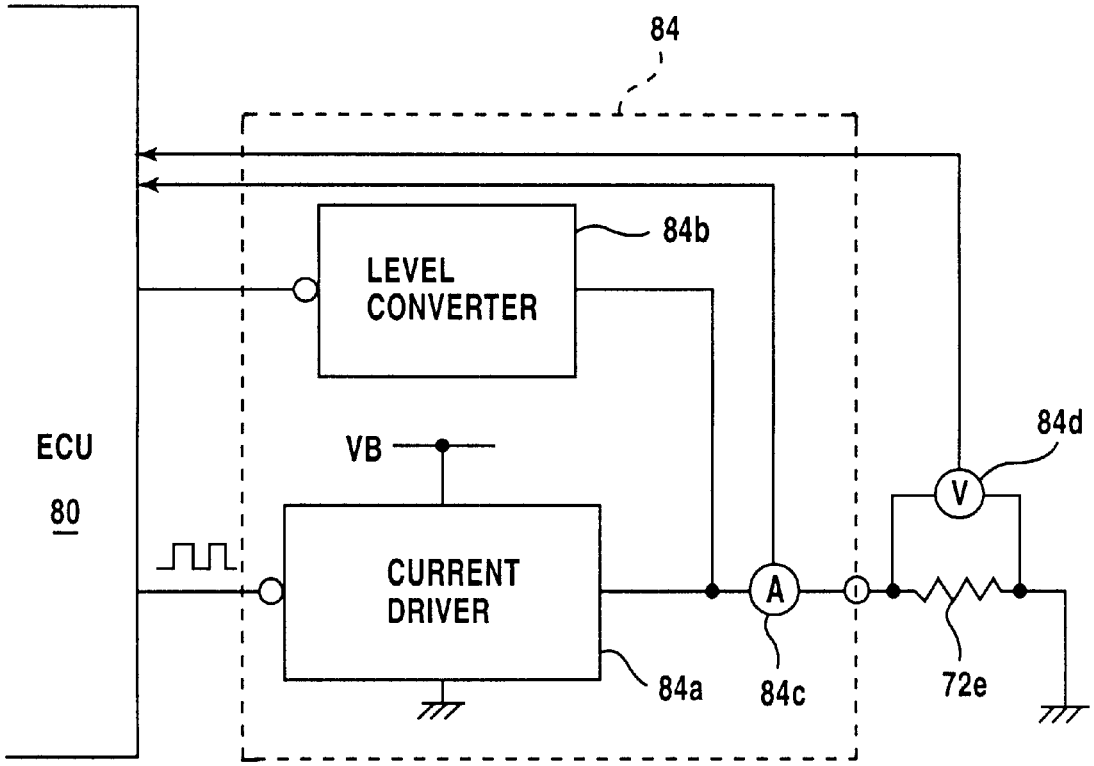
FIG. 3 is a circuit diagram showing the details of a heater current supply circuit of the sensing element illustrated in FIG. 2.

FIG. 3 is a circuit diagram of the heater current supply circuit 84.

As illustrated, the heater current supply circuit 84 has a current driver 84*a* which regulates the power source voltage (battery voltage) VB in response to a duty ratio in PWM (Pulse-Width Modulation), which is determined or calculated by the ECU 80 as will be explained later, to supply the current to the heater 72*e*. The ECU 80 monitors the current through a level converter 84*b* and prevents an excessive current from flowing to the heater 72*e*.

The heater current supply circuit 84 is provided with a current sensor 84*c* for detecting the current supplied to the heater 72*e* and a voltage sensor 84*d* for detecting the voltages across the heater 72*e*. The outputs of the sensors 84*c*, 84*d* are forwarded to the ECU 80.

The ECU 80 determines or calculates the resistance of the heater 72*e* based on the sensor outputs. The heater temperature (amount of heat) relative to the heater resistance is, for example, 25° C. or thereabout at 3.15 Ω, 800° C. or thereabout at 9.0 Ω, and is approximately linear. Accordingly, the system is configured to detect or estimate the temperature of the LAF sensor 72, more precisely, the temperature of its sensing element (named "TLAF") and based on the detected or estimated sensor temperature TLAF, to conduct the temperature control of the heater 72*e* through PWM.

Figure 4:
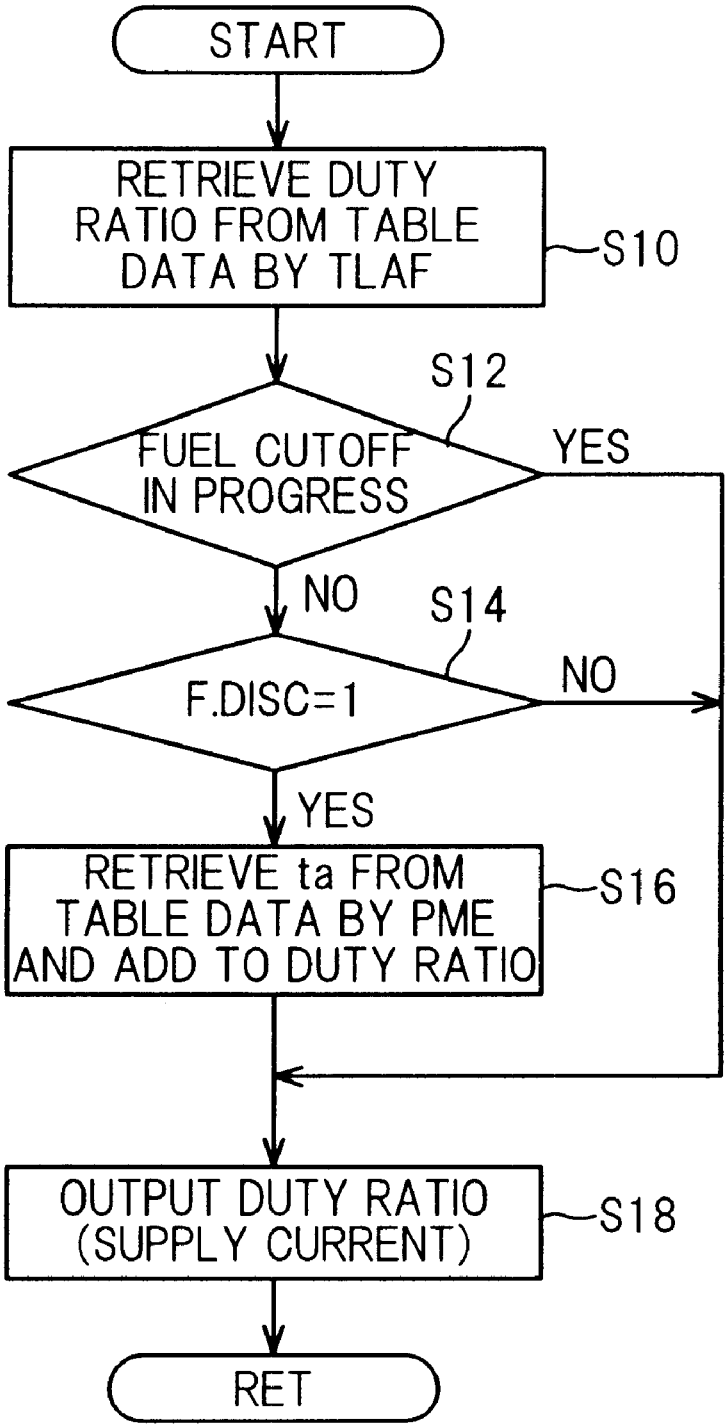
FIG. 4 is a flow chart showing the operation of the system illustrated in FIG. 1.

FIG. 4 is a flow chart showing the operation of the heater temperature control, more generally the operation of the control system of air-fuel ratio sensor heater temperature for an internal control according to the embodiment of the invention. The program of this flow chart is executed at a prescribed time interval such as 100 msec.

Figure 5A:
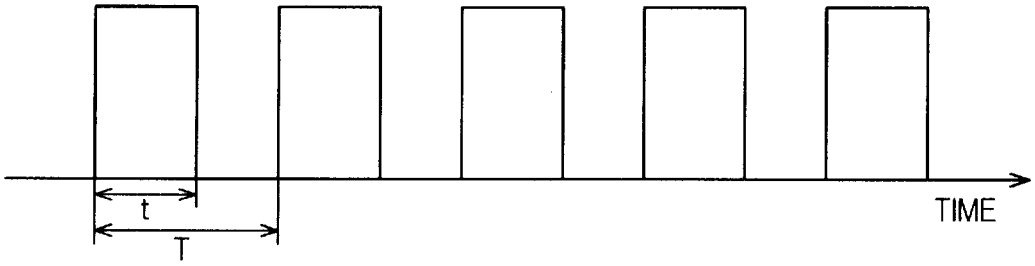
FIGS. 5A–5C is a set of graphs showing a duty ratio, a characteristic of the duty ratio and an augmentative on-time, all referred to in the flow chart of FIG. 4.

The program begins in S10 in which the duty ratio is retrieved from table data using the detected sensor temperature TLAF as address data. Explaining this with reference to FIG. 5, as illustrated in FIG. 5A, the duty ratio (defined by on-time t divided by period T) is first determined through the table data retrieval and based thereon, the current in proportion to the duty ratio is supplied to the heater 72*e* through the current driver 84*a* to heat the same.

Figure 5B:
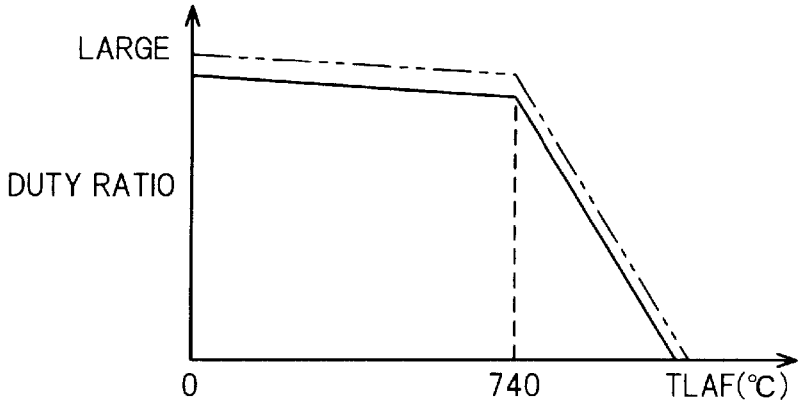

FIG. 5B shows the characteristic of the table data of the duty ratio which is illustrated by solid lines. As illustrated, the duty ratio is set to be maximum (e.g. 90% to 95%) when the sensor temperature is below a predetermined temperature (e.g. 740° C.) and to decrease gradually when the sensor temperature exceeds the predetermined temperature of 740° C. It should be noted that the characteristic is prepared on the assumption that the form of combustion is the pre-mixture charged combustion.

Returning to the explanation of FIG. 4, the program proceeds to S12 in which it is determined whether the fuel supply is cutoff. Since the throttle valve 18 is driven to the closing direction to reduce the intake air amount when the fuel cutoff is in progress, the sensor temperature drops little. For that reason, when the result in S12 is affirmative, the program skips S14 and S16.

When the result in S12 is negative, on the other hand, the program proceeds to S14 in which it is determined whether the bit of a flag F.DISC is set to 1. In a routine (not shown), the bit of the flag is set to 1 when it is determined that the engine 10 should be operated at the ultra-lean burn combustion, while it is reset to 0 when the engine 10 should be operated at the pre-mixture charged combustion.

Therefore, the procedure in this step corresponds to determine whether the engine 10 is operated at the ultra-lean burn combustion. The reason is that, as mentioned above, since the combustion temperature drops in the ultra-lean burn combustion and heat transfer from the sensing element to the ambient exhaust gas increases, which results in the change of the element resistance and could, at worse, degrade the sensing function due to the change occurring in the molecular structure called blacking.

Figure 5C:
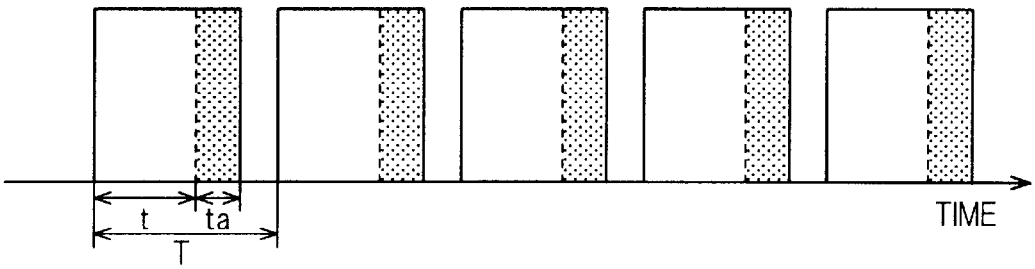
Figure 6A:
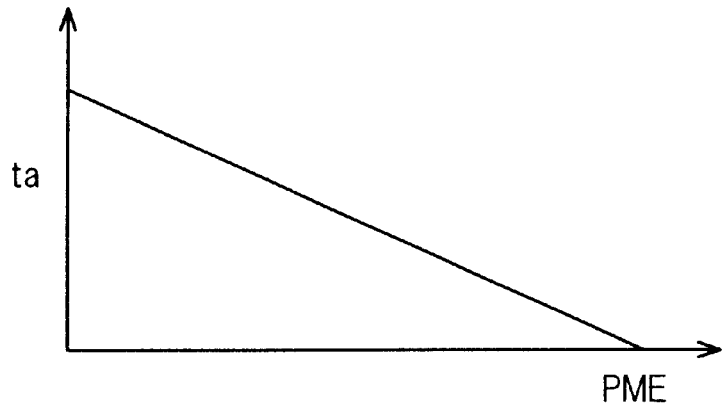
FIGS. 6A–6D are graphs showing characteristics of the augmentative on-time all referred to in the flow chart of FIG. 4.

When the result in S14 is affirmative, the program proceeds to S16 in which an augmentative on-time ta is retrieved from table data (whose characteristic is shown in FIG. 6A using the desired torque PME as address data and is added to the on-time t. As illustrated in FIG. 5C, when the engine 10 is operated at the ultra-lean burn combustion, the on-time t is added by the augmentative on-time ta (shown as the hatched portion) such that the duty ratio is increased. As illustrated in FIG. 6A, the augmentative on-time ta is set to decrease with increasing desired torque PME.

In the flow chart of FIG. 4, the program proceeds to S18 in which the determined duty ratio is output and based on the determined duty ratio, the current is supplied to the heater 72*e*. With this, when the heater 72*e* of the LAF sensor 72 is supplied with the current through the current driver 84*a*, the duty ratio is increased such the amount of heat increases. On the other hand, when the result in S12 is affirmative or when the result in S14 is negative, the program proceeds immediately to S18 in which the supply of current is conducted based on the duty ratio determined in S10.

In the embodiment, thus, since the system is configured to determine the duty ratio based on the detected or estimated sensor temperature TLAF such that the heater 72*e* of the LAF sensor 72 is heated based on the duty ratio, it can control the temperature of the sensing element of the LAF sensor 72 within a desired range, thereby enabling to achieve an adequate detection accuracy of the air/fuel ratio.

Furthermore, since the system is configured to conduct the heater temperature control in response to the form of combustion, more specifically, to increase the amount of current supply when the engine 10 is operated at the ultra-lean burn combustion such that the amount of heat increases, it can prevent the temperature of the sensing element from dropping even if the form of combustion is switched from the pre-mixture charged combustion to the ultra-lean burn combustion, thereby enabling to prevent the function of the sensor from being degraded.

Figure 7:
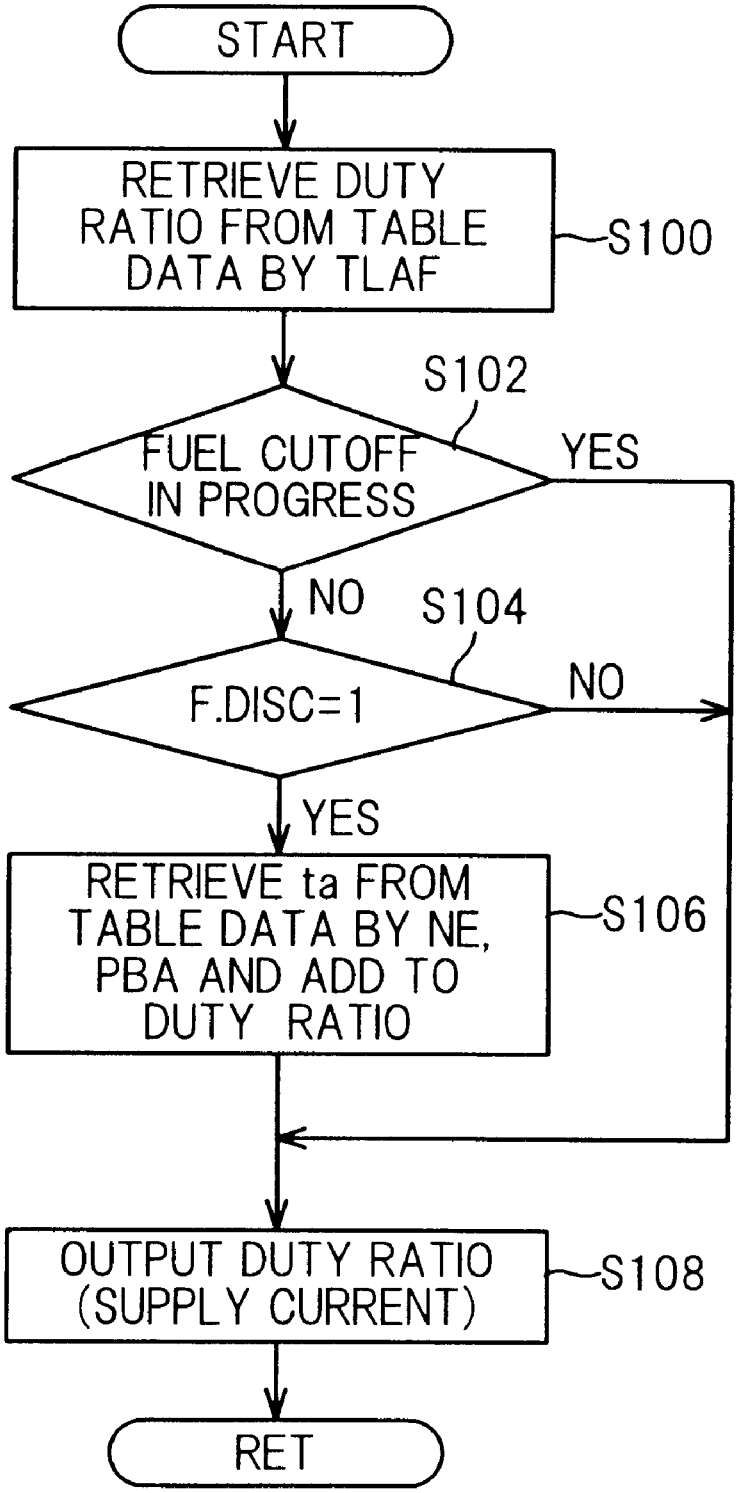
FIG. 7 is a view, similar to FIG. 4, but showing a control system of air-fuel ratio sensor heater temperature for an internal combustion engine according to a second embodiment of the invention.

FIG. 7 is a view, similar to FIG. 4, but showing the operation of the control system of air/fuel ratio sensor heater temperature for an internal combustion engine according to a second embodiment of the invention.

Figure 6B:
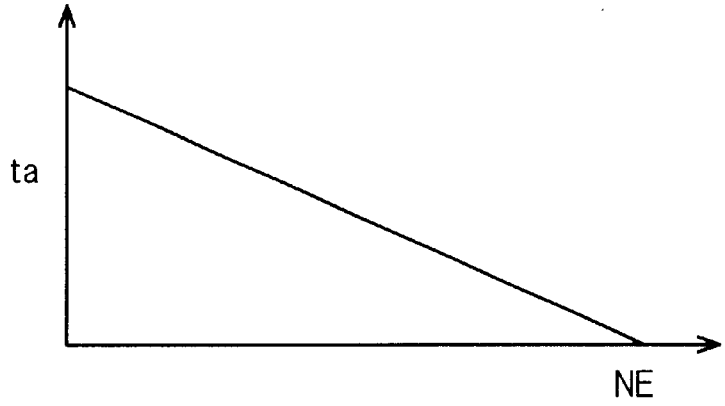
Figure 6C:
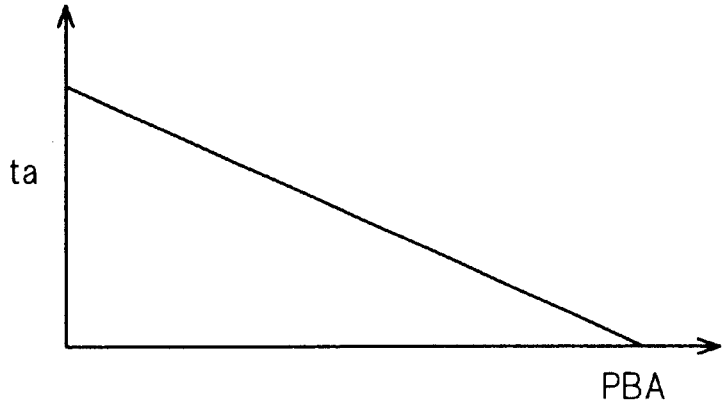

Explaining this with focus on the differences from the first embodiment, the program begins in S100 and proceeds, via S102, S104, to S106 in which the augmentative on-time ta is retrieved from table data (whose characteristics are shown in FIGS. 6A and 6B using the engine speed NE and the engine load (manifold absolute pressure PBA) as address data respectively. As illustrated in the figures, the augmentative on-time ta is set to decrease with increasing engine speed NE and the increasing manifold absolute pressure PBA.

The rest of the configuration as well as the effects and advantages is the same as the first embodiment except that the augmentative on-time ta is determined from the engine speed NE and the engine load (manifold absolute pressure PBA) respectively.

Figure 8:
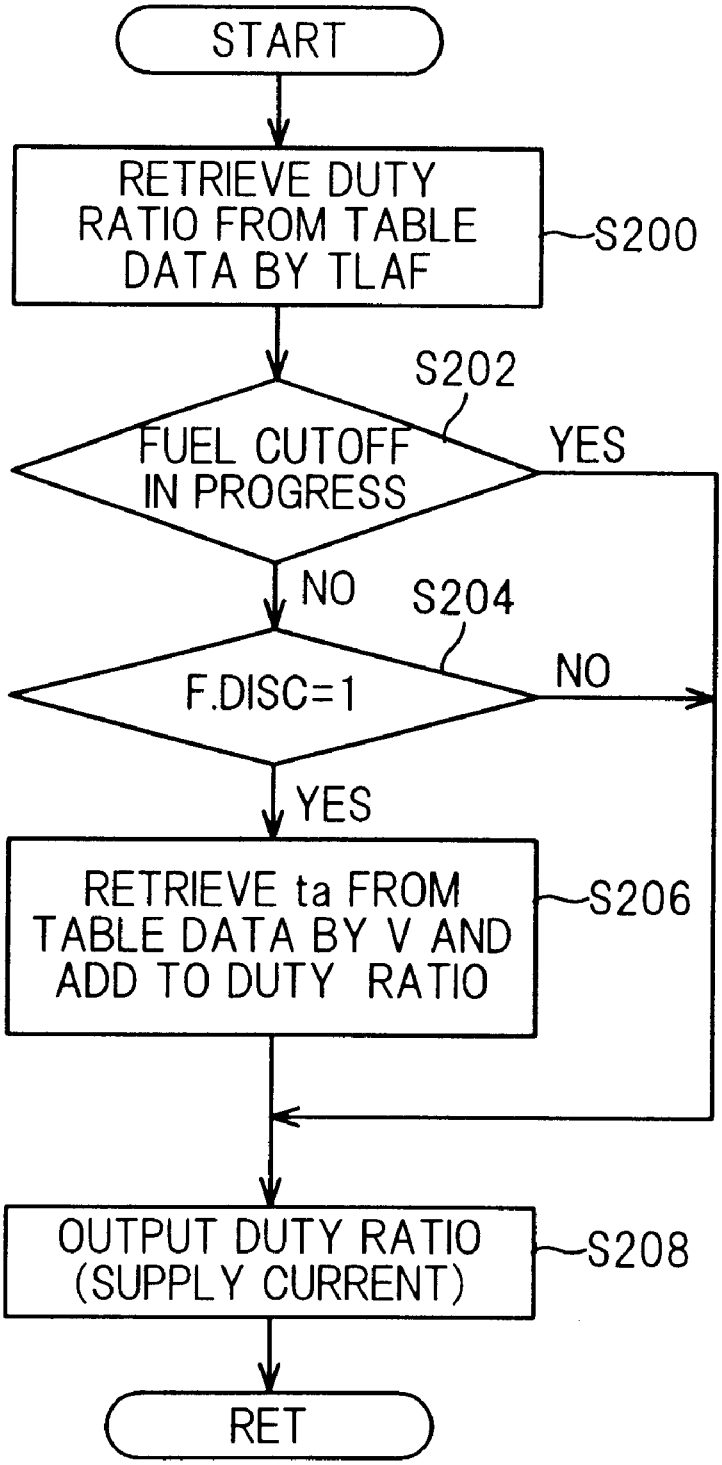
FIG. 8 is a view, similar to FIG. 4, but showing a control system of air-fuel ratio sensor heater temperature for an internal combustion engine according to a third embodiment of the invention.

FIG. 8 is a view, similar to FIG. 4, but showing the operation of the control system of air/fuel ratio sensor heater temperature for an internal combustion engine according to a third embodiment of the invention.

Figure 6D:
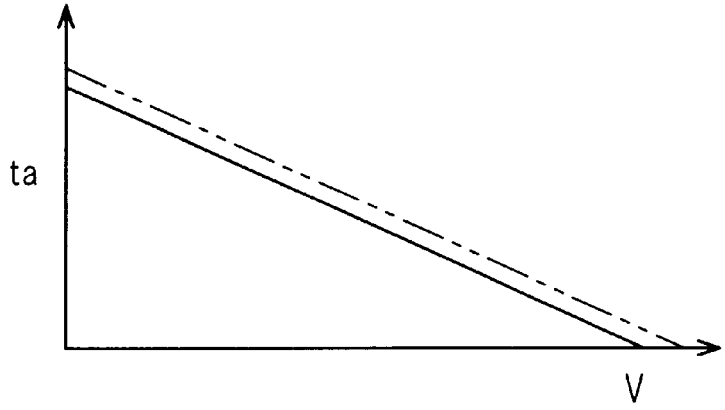

Explaining this with focus on the differences from the first embodiment, the program begins in S200 and proceeds, via S202, S204, to S206 in which the augmentative on-time ta is respectively retrieved from table data (whose characteristics are shown in FIG. 6D using the vehicle speed V (indicative of the vehicle running condition) as address data. As illustrated in the figures, the augmentative on-time ta is set to decrease with increasing vehicle speed V.

The rest of the configuration as well as the effects and advantages is the same as the first embodiment except that the augmentative on-time ta is determined from the vehicle speed V indicative of the vehicle running condition.

Figure 9:
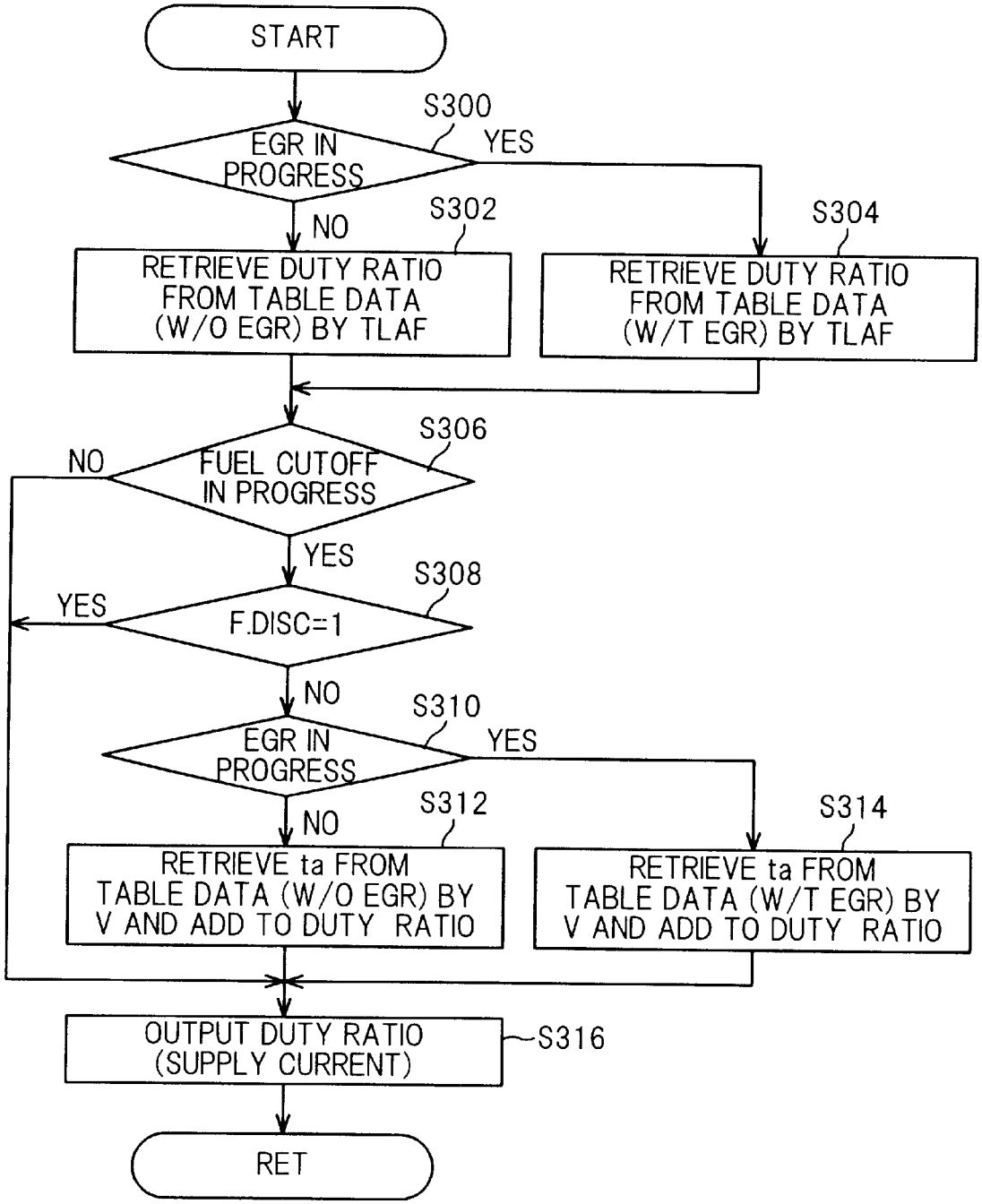
FIG. 9 is a view, similar to FIG. 4, but showing a control system of air-fuel ratio sensor heater temperature for an internal combustion engine according to a fourth embodiment of the invention.

FIG. 9 is a view, similar to FIG. 4, but showing the operation of the control system of air/fuel ratio sensor heater temperature for an internal combustion engine according to a fourth embodiment of the invention.

Explaining this with focus on the differences from the first embodiment, in the fourth embodiment, the duty ratio and the augmentative on-time are determined in response to the fact whether the EGR is in progress. This is because the combustion temperature changes due to the recirculated exhaust gas caused by the EGR.

The program begins in S300 in which it is determined whether the operation of EGR is in progress. This is done by detecting the amount of lift of the EGR control valve 52 through a lift sensor or by reading the value of the EGR correction coefficient KEGR.

When the result in S300 is negative, the program proceeds to S302 in which the duty ratio is determined by retrieving the table data without EGR operation (i.e. that shown in FIG. 5B by solid lines) from the sensor temperature TLAF in the same manner as the first embodiment. On the other hand, when the result in S300 is affirmative, the program proceeds to S304 in which the duty ratio is determined by retrieving table data (with EGR operation whose characteristic is shown in FIG. 5B in phantom lines) using the same parameter as address data.

The program then proceeds, via S306 and S308, to S310 in which it is again determined whether the operation of EGR is in progress.

When the result in S310 is negative, the program proceeds in S312 in which the augmentative on-time ta is determined by retrieving the table data without EGR operation (i.e. that shown in FIG. 6D by solid lines) from the vehicle speed V in the same manner as the third embodiment and is added to increase the duty ratio. On the other hand, when the result in S310 is affirmative, the program proceeds to S314 in which the augmentative on-time ta is determined by retrieving table data (whose characteristic is shown in FIG. 6D in phantom lines) using the same parameter as address data and is added to increase the duty ratio. The program then proceeds to S316 in which the determined duty ratio is output.

In the fourth embodiment, thus, since the system is configured to determine the duty ratio and the augmentative on-time based on the determination whether the EGR is in progress, it can achieve a more adequate detection accuracy of the air/fuel ratio and prevent the function of the sensor from being degraded more effectively.

It should be noted in the fourth embodiment, although the augmentative on-time ta is determined based on the vehicle speed V, it is alternatively possible to determine it based on the other parameters used in the foregoing embodiments, such as the desired torque PME used in the first embodiment.

The first to fourth embodiments are thus configured to have a system for controlling a temperature of a heater (72*e*) of an air-fuel ratio sensor (72) installed in an internal combustion engine (10) and generating a signal indicative of an air/fuel ratio in an exhaust gas generated by the engine; including; the heater (72*e*) installed at the air/fuel ratio sensor (72) and for heating a sensing element of the air/fuel ratio sensor when supplied with current; and current supply control means (ECU 80, S10, S100, S200, S302, S304) for controlling a supply of current to the heater. In the system, the engine (10) is a direct injection spark ignition engine which is operated at an ultra-lean burn combustion or at a premixture charged combustion; and the system includes: sensor temperature determining means (ECU 80, sensors 84*c*, 84*d*) for determining the temperature of the air-fuel ratio sensor (TLAF); and combustion determining means (ECU 80, S14, S104, S204, S308) for determining whether the engine is operated at the ultra-lean burn combustion; and the current supply control means (ECU 80, S16, S18, S106, S206, S206, S310–S316) controls the supply of current to the heater based at least on the determined temperature of the air-fuel ratio sensor and a result of determination whether the engine is operated at the ultra-lean burn combustion.

In the system, the current supply control means controls to increase the supply of current when the engine is determined to be operated at the ultra-lean burn combustion (ECU 80, S16, S18, S106, S108, S206, S208, S310–S316).

The system further includes engine operating condition detecting means (ECU 80, sensors 62, 66, 76, 78) for detecting at least one operating condition of the engine and a running condition of a vehicle on which the engine is mounted; and augmentative amount determining means (ECU 80, S16, S106, S206, S312, S314) for determining an augmentative amount (ta) based at least on a parameter obtained based on the operating conditions of the engine and the running condition of the vehicle; and the current supply control means controls to increase the supply of current by adding the augmentative amount to the current.

In the system, the argumentative amount determines the augmentative amount based on a desired torque (PME) determined by an engine speed and a position of an accelerator pedal.

In the system, the argumentative amount determines the augmentative amount based on an engine speed (NE) and a position of an engine load (PBA).

In the system, the argumentative amount determines the augmentative amount based on the running condition of the vehicle (V).

In the system, the running condition of the vehicle is a vehicle speed (V).

The system further includes EGR operation determining means (ECU 80, S300, S310) for determining whether an operation of an EGR is in progress during which the exhaust gas is partially recirculated into an air intake system of the engine; and the current supply control means controls to increase the supply of current when the operation of the EGR is in progress (ECU 80, S304, S314).

In the system, the supply of current is determined in terms of a duty ratio in PWM.

In the above, "at least" means that any other parameter(s) may instead by used.

While the invention has thus been shown and described with reference to specific embodiments, it should be noted that the invention is in no way limited to the details of the described arrangements but changes and modifications may be made without departing from the scope of the appended claims.

What is claimed is:

1. A system for controlling a temperature of a heater of an air-fuel ratio sensor installed in an internal combustion engine and generating a signal indicative of an air/fuel ratio in an exhaust gas generated by the engine; including;

the heater installed at the air/fuel ratio sensor and for heating a sensing element of the air/fuel ratio sensor when supplied with current; and current supply control means for controlling a supply of current to the heater;

wherein the improvement comprises;

the engine is a direct injection spark ignition engine which is operated at an ultra-lean burn combustion or at a pre-mixture charged combustion; and, the system includes:

sensor temperature determining means for determining the temperature of the air-fuel ratio sensor; and combustion determining means for determining whether the engine is operated at the ultra-lean burn combustion;

and the current supply control means controls the supply of current to the heater based at least on the determined temperature of the air-fuel ratio sensor and a result of determination whether the engine is operated at the ultra-lean burn combustion.

2. A system according to claim 1, wherein the current supply control means controls the supply of current based on the determined temperature of the air-fuel ratio sensor such that it is a value when the determined temperature is below a predetermined temperature and decreases with increasing temperature when the determined temperature exceeds the predetermined temperature.

3. A system according to claim 1, wherein the current supply control means controls to increase the supply of current when the engine is determined to be operated at the ultra-lean burn combustion.

4. A system according to claim 2, further including:

engine operating condition detecting means for detecting at least one operating condition of the engine and a running condition of a vehicle on which the engine is mounted; and augmentative amount determining means for determining an augmentative amount based at least on a parameter obtained based on the operating conditions of the engine and the running condition of the vehicle;

and the current supply control means controls to increase the supply of current by adding the augmentative amount to the current.

5. A system according to claim 4, wherein the argumentative amount determines the augmentative amount based on a desired torque determined by an engine speed and a position of an accelerator pedal.

6. A system according to claim 5, wherein the augmentative amount determining means determines the augmentative amount based on the desired torque such that it decreases with increasing desired torque.

7. A system according to claim 4, wherein the argumentative amount determines the augmentative amount based on an engine speed and an engine load.

8. A system according to claim 7, wherein the augmentative amount determining means determines the augmentative amount based on the engine speed, such that it decreases with increasing engine speed and engine load.

9. A system according to claim 4, wherein the argumentative amount determines the augmentative amount based on the running condition of the vehicle.

10. A system according to claim 9, wherein the running condition of the vehicle is a vehicle speed.

11. A system according to claim 10, wherein the augmentative amount determining means determines the augmentative amount based on the vehicle speed such that it decreases with increasing vehicle speed.

12. A system according to claim 2, further including;

EGR operation determining means for determining whether an operation of an EGR is in progress during which the exhaust gas is partially recirculated into an air intake system of the engine;

and the current supply control means controls to increase the supply of current when the operation of the EGR is in progress.

13. A system according to claim 4, further including;

EGR operation determining means for determining whether an operation of an EGR is in progress during which the exhaust gas is partially recirculated into an air intake system of the engine;

and the current supply control means controls to increase the augmentative amount when the operation of the EGR is in progress.

14. A system according to claim 1, wherein the supply of current is determined in terms of a duty ratio in PWM.

15. A method of controlling a temperature of a heater of an air-fuel ratio sensor generating a signal indicative of an air/fuel ratio in an exhaust gas generated by the engine which is a direct injection spark ignition engine which is operated at an ultra-lean burn combustion or at a pre-mixture charged combustion; comprising the steps of;

determining the temperature of the air-fuel ratio sensor; and a determining whether the engine is operated at the ultra-lean burn combustion;

and controlling a supply of current to the heater based at least on the determined temperature of the air-fuel ratio sensor and a result of determinating whether the engine is operated at the ultra-lean burn combustion.

16. A method according to claim 15, wherein the supply of current is controlled based on the determined temperature of the air-fuel ratio sensor such that it is a value when the determined temperature is below a predetermined temperature and decreases with increasing temperature when the determined temperature exceeds the predetermined temperature.

17. A method according to claim 15, wherein the current supply is controlled to increase the supply of current when the engine is determined to be operated at the ultra-lean burn combustion.

18. A method according to claim 16, further including step of:

detecting at least one operating condition of the engine and a running condition of a vehicle on which the engine is mounted; and determining an augmentative amount based at least on a parameter obtained based on the operating conditions of the engine and the running condition of the vehicle;

and the current supply is controlled to increase the supply of current by adding the augmentative amount to the current.

19. A method according to claim 18, wherein the augmentative amount is determined based on a desired torque determined by an engine speed and a position of an accelerator pedal.

20. A method according to claim 19, wherein the augmentative amount is determined based on the desired torque such that it decreases with increasing desired torque.

21. A method according to claim 18, wherein the argumentative amount is determined based on an engine speed and an engine load.

22. A method according to claim 21, wherein the augmentative amount is determined based on the engine speed and such that it decreases with increasing engine speed and engine load.

23. A method according to claim 18, wherein the argumentative amount is determined based on the running condition of the vehicle.

24. A method according to claim 23, wherein the running condition of the vehicle is a vehicle speed.

25. A method according to claim 24, wherein the augmentative amount is determined based on the vehicle speed such that it decreases with increasing vehicle speed.

26. A method according to claim 16, further including the step of;

determining whether an operation of an EGR is in progress during which the exhaust gas is partially recirculated into an air intake system of the engine;

and the current supply is controlled to increase the supply of current when the operation of the EGR is in progress.

27. A method according to claim 18, further including;

determining whether an operation of an EGR is in progress during which the exhaust gas is partially recirculated into an air intake system of the engine;

and the current supply is controlled to increase the augmentative amount when the operation of the EGR is in progress.

28. A method according to claim 15, wherein the supply of current is determined in terms of a duty ratio in PWM.

* * * * *